US008220536B2

(12) United States Patent
Tao et al.

(10) Patent No.: US 8,220,536 B2
(45) Date of Patent: Jul. 17, 2012

(54) DOWNHOLE FLUID COMMUNICATION APPARATUS AND METHOD

(75) Inventors: Chen Tao, Sugar Land, TX (US); Danny A. Hlavinka, Houston, TX (US); Jonathan W. Brown, Sugar Land, TX (US); Christopher S. Del Campo, Houston, TX (US); Stephane Briquet, Houston, TX (US); Steve Ervin, Brookshire, TX (US); Kevin W. Hayes, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/716,882

(22) Filed: Mar. 3, 2010

(65) Prior Publication Data

US 2010/0155053 A1 Jun. 24, 2010

Related U.S. Application Data

(62) Division of application No. 11/609,188, filed on Dec. 11, 2006, now abandoned.

(51) Int. Cl.
*E21B 33/12* (2006.01)

(52) U.S. Cl. ..... 166/100; 166/264; 166/179

(58) Field of Classification Search ..... 166/100.264, 166/179; 175/50; 73/152.26, 152.17
See application file for complete search history.

(56) References Cited

U.S. PATENT DOCUMENTS

| | | | | |
|---|---|---|---|---|
| 2,674,313 | A | | 4/1954 | Chambers |
| 3,173,485 | A | | 3/1965 | Bretzke, Jr. |
| 3,295,615 | A | | 1/1967 | Brieger et al. |
| 3,344,860 | A | * | 10/1967 | Voetter ..... 166/100 |
| 3,565,169 | A | | 2/1971 | Bell |
| 3,688,849 | A | | 9/1972 | Briggs, Jr. |
| 4,287,946 | A | | 9/1981 | Brieger |
| 4,860,581 | A | | 8/1989 | Zimmerman et al. |
| 4,936,139 | A | | 6/1990 | Zimmerman et al. |
| 6,301,959 | B1 | | 10/2001 | Hrametz et al. |
| 6,585,045 | B2 | | 7/2003 | Lee et al. |
| 6,609,568 | B2 | | 8/2003 | Krueger et al. |
| 7,114,385 | B2 | | 10/2006 | Fisseler et al. |
| 2002/0056667 | A1 | | 5/2002 | Baltzer |
| 2004/0000433 | A1 | | 1/2004 | Hill et al. |
| 2004/0173351 | A1 | | 9/2004 | Fox et al. |
| 2005/0103689 | A1 | | 5/2005 | Schulte, Jr. |
| 2005/0161218 | A1 | * | 7/2005 | van Zuilekom et al. ..... 166/264 |
| 2005/0224398 | A1 | | 10/2005 | Largent |
| 2005/0274655 | A1 | | 12/2005 | Barrett |
| 2006/0075813 | A1 | | 4/2006 | Fisseler et al. |
| 2006/0076132 | A1 | | 4/2006 | Nold, III et al. |
| 2006/0163122 | A1 | | 7/2006 | Bakula |

FOREIGN PATENT DOCUMENTS

| | | |
|---|---|---|
| GB | 2384796 | 8/2003 |
| GB | 2418938 | 4/2006 |
| WO | 03097999 | 11/2003 |

* cited by examiner

*Primary Examiner* — William P Neuder
*Assistant Examiner* — Yong-Suk Ro
(74) *Attorney, Agent, or Firm* — David J. Smith

(57) ABSTRACT

A probe for establishing fluid communication between a downhole tool and a subterranean formation. The downhole tool is positioned in a wellbore penetrating the subterranean formation. The probe includes a platform operatively connected to the downhole tool, at least one packer operatively connected to the platform, the packer having at least one hole extending therethrough and at least one embedded member disposed in the packer for enhancing the operation of the packer as it is pressed against the wellbore wall.

2 Claims, 13 Drawing Sheets

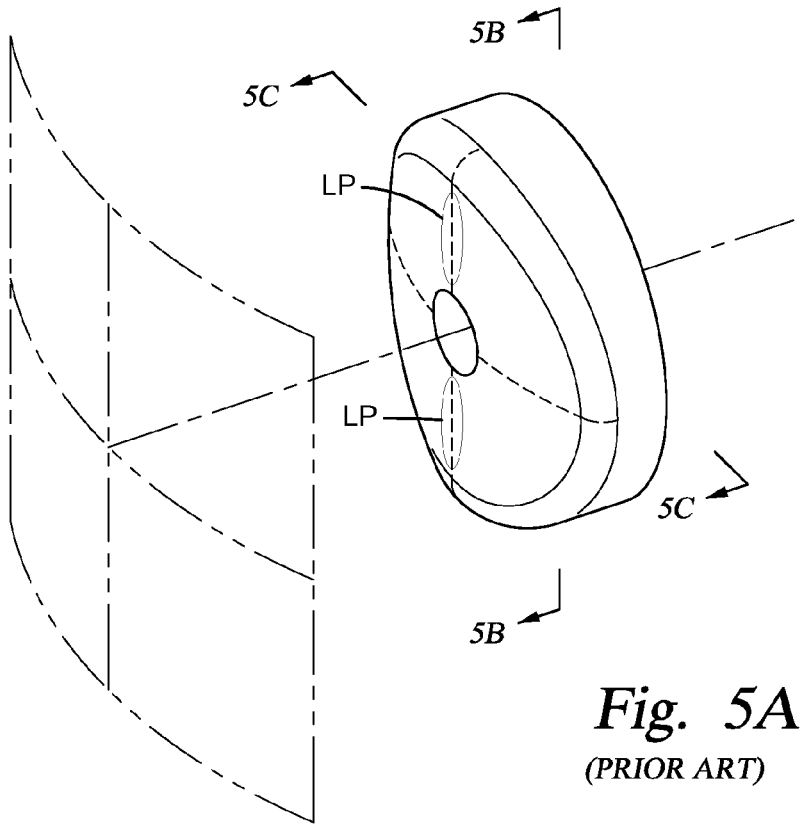
Fig. 5A
(PRIOR ART)
Fig. 5B
(PRIOR ART)
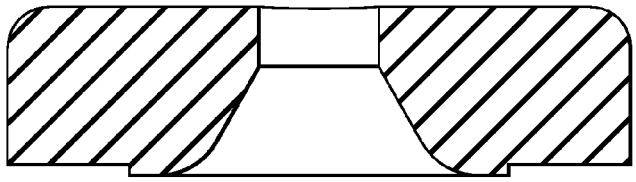
Fig. 5C
(PRIOR ART)
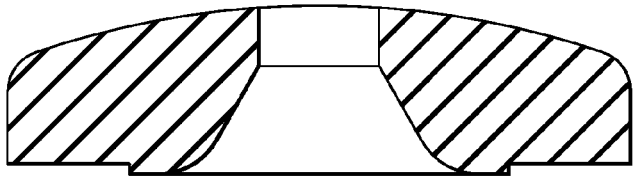

DOWNHOLE FLUID COMMUNICATION APPARATUS AND METHOD

CROSS REFERENCE TO RELATED APPLICATIONS

This application is a divisional of U.S. patent application Ser. No. 11/609,188, filed Dec. 11, 2006, which is a non-provisional application of U.S. Provisional Patent Application 60/751,017, filed Dec. 16, 2005, the content of which is incorporated herein by reference for all purposes.

BACKGROUND OF THE DISCLOSURE

1. Field of the Invention

The present invention relates to techniques for establishing fluid communication between a subterranean formation and a downhole tool positioned in a wellbore penetrating the subterranean formation. More particularly, the present invention relates to probes and associated techniques for drawing fluid from the formation into the downhole tool.

2. Background of the Related Art

Wellbores are drilled to locate and produce hydrocarbons. A downhole drilling tool with a bit at an end thereof is advanced into the ground to form the wellbore. As the drilling tool is advanced, a drilling mud is pumped through the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. These samples or tests may be used, for example, to locate and evaluate valuable hydrocarbons.

Formation evaluation often requires that fluid from the formation be drawn into the downhole tool for testing and/or sampling. Various devices, such as probes, are extended from the downhole tool to establish fluid communication with the formation surrounding the wellbore and draw fluid into the downhole tool. A typical probe is an element that may be extended from the downhole tool and positioned against the sidewall of the wellbore. A packer at the end of the probe is used to create a seal with the wall of the formation. The mudcake lining the wellbore is often useful in assisting the packer in making the seal. Once the seal is made, fluid from the formation is drawn into the downhole tool through an inlet in the probe by lowering the pressure in the downhole tool. Examples of such probes used in wireline and/or drilling tools are described in U.S. Pat. Nos. 6,301,959; 4,860,581; 4,936,139; 6,585,045 and 6,609,568 and U.S. Patent Application Nos. 2004/0000433 and 2004/0173351, and U.S. patent application Ser. No. 10/960,403. In some cases, probes have been provided with mechanisms to support the packer as described in US Patent Application No. 2005/0161218 and U.S. application Ser. No. 10/960,404.

Despite the advances in probe technology, there remains a need for a reliable probe that is capable of operating in extremely harsh wellbore conditions. During operation, the seal between the packer and the wellbore wall may be incomplete or lost. The probe and/or packer may deteriorate or destroyed due to extreme temperatures and/or pressure, or due to contact with certain surfaces. When a probe fails to make a sufficient seal with the wellbore wall, problems may occur, such as contamination by wellbore fluids seeping into the downhole tool through the inlet, lost pressure and other problems. Such problems may cause costly delays in the wellbore operations by requiring additional time for more testing and/or sampling. Additionally, such problems may yield false results that are erroneous and/or unusable.

There also remains a need for a probe that routinely provides an adequate seal with the formation, particularly in cases where the surface of the well is rough and the probe may not have good contact with the wellbore wall. It is desirable that such a probe be provided with mechanisms that provide additional support to assure a good seal with the wellbore wall. Moreover, it is desirable that such a probe conforms to the shape of the wellbore, distributes forces about the probe and/or reduces the likelihood of failures. It is further desirable that such a probe and/or packer be capable of one or more of the following, among others: durable in even the harshest wellbore conditions, capable of forming a good seal, capable of conforming to the wellbore wall, adaptable to various wellbore conditions, capable of detecting certain downhole conditions, capable of retaining packer shape, resistant to deformation in certain areas and/or resistant to damage.

SUMMARY OF THE DISCLOSURE

In one aspect of the disclosure, a probe for establishing fluid communication between a downhole tool and a subterranean formation is provided. The probe includes a platform that is operatively connected to the downhole tool, and at least one packer that is operatively connected to the platform. The packer have at least one hole extending through the packer, and includes at least one embedded member disposed in the packer for enhancing the operation of the packer as it is pressed against the wellbore wall whereby the packer forms a seal with the wellbore wall.

In another aspect of the disclosure, a probe for establishing fluid communication between a downhole tool and a subterranean formation is provided. The probe includes a base operatively connected to the downhole tool, and at least one packer operatively connected to the base. The packer have at least one hole extending through the packer, and includes a first rigid portion and a second rigid portion. The first rigid portion is fixedly attached to the packer, and the second rigid portion slidably engages the first rigid portion, thereby permitting movement of at least a portion of the packer relative to the second rigid portion as the packer is pressed against a wellbore wall.

In yet another aspect of the disclosure, a packer for establishing fluid communication between a downhole tool and a subterranean formation is provided. The packer has a generally circular shape and a central axis. The central axis of the packer is substantially perpendicular to a vertical axis of the wellbore. An outer surface of the packer is adapted to engage a borehole wall and has a first radius and a first center point. An inner surface of the packer is disposed a first distance apart from the outer surface and is adapted to engage a base. The inner surface has a second radius and a second center point, such that the first and second center points are on the central axis and such that a second distance between the two center points is between zero and the first distance. The second radius is substantially equal to the sum of the first radius and the second distance minus the first distance.

In yet another aspect of the disclosure, a packer for establishing fluid communication between a downhole tool and a subterranean formation is disclosed. The packer has a central axis. The central axis is substantially perpendicular to a vertical axis of the wellbore. A base is operatively connected to the downhole tool and to the packer that has at least one hole extending therethrough. An outer surface of the packer is adapted to engage a borehole wall and includes an outer surface having a first radius, wherein the first radius is smaller than a radius of the wellbore.

In yet another aspect of the disclosure, a method of establishing fluid communication between a downhole tool and a subterranean formation is provided. The method includes providing a packer having a contact surface adapted to engage a borehole wall and an inner surface; abutting the contact surface of the packer against a borehole wall; applying a force against the inner surface of the packer, thereby pressing the packer against the borehole wall; and creating a substantially homogenous pressure between the borehole wall and the contact surface.

In another aspect of the disclosure, a probe for establishing fluid communication between a downhole tool and a subterranean formation is provided. The probe includes a base operatively connected to the downhole tool and at least one packer having an inner portion and an outer portion that is operatively connected to the base. The packer includes at least one hole extending therethrough and at least one support structure disposed along a portion of the packer. The structure has a first end disposed between the base and an outer surface of the packer, such that the end includes a curved portion extending away from the portion of the packer.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIG. 5A is an isometric view of a prior art packer against a borehole wall;

FIG. 5B is a cross-sectional view of the packer of FIG. 5A along line B-B;

FIG. 5C is a cross-sectional view of the packer of FIG. 5A along line C-C;

DETAILED DESCRIPTION

Figure 1A:
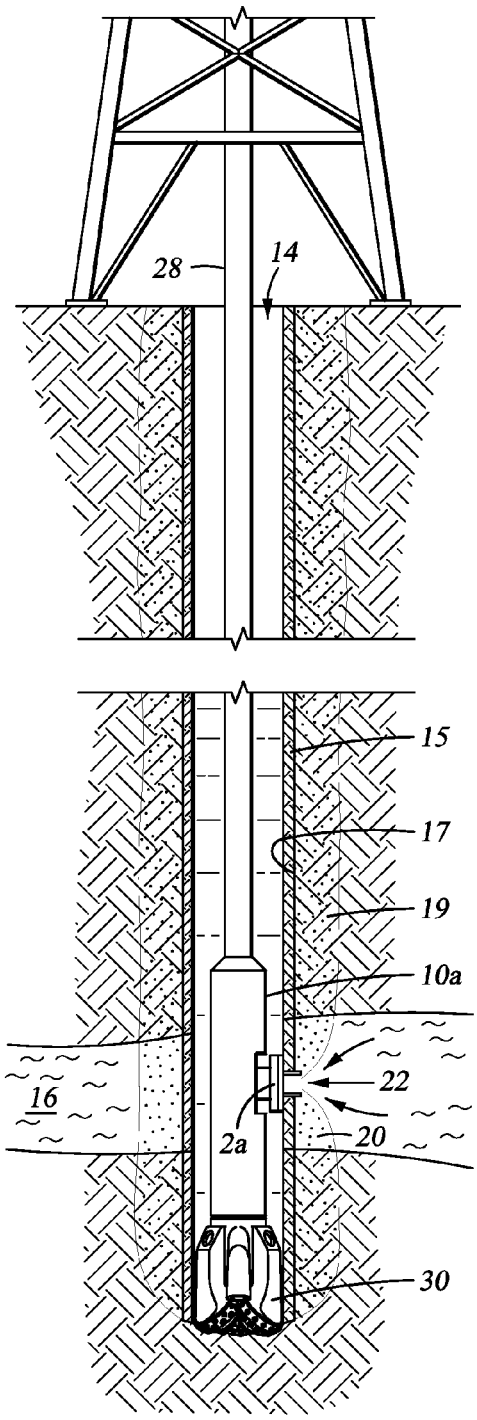
FIG. 1A is a front view, partially in cross-section of a downhole drilling tool deployed from a rig into a wellbore, the downhole drilling tool having a probe with a single inlet extending therefrom.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

In the illustrated example, the present invention is carried by a down hole tool, such as the drilling tool 10*a* of FIG. 1 or the wireline tool 10*b* of FIG. 2. The present invention may also be used in other downhole tools adapted to draw fluid therein, such as coiled tubing, casing drilling and other variations of downhole tools.

FIG. 1A depicts the downhole drilling tool 10*a* advanced into the earth to form a wellbore or borehole 14. The drilling tool 10*a* has a bit 30 at an end thereof adapted to cut into the earth to form the wellbore 14. The drilling tool 10*a* is deployed into the wellbore via a drill string 28. As the drilling tool is advanced, a drilling mud (not shown) is pumped into the wellbore through the drilling string 28 and out the bit 30. The mud is circulated up the wellbore 14 and back to the surface for recycling. As the tool advances and mud is pumped into the wellbore 14, the mud seeps into the walls 17 of the wellbore 14 and penetrates surrounding formations. As indicated by reference number 15, the mud lines the wellbore wall 17 and forms a mudcake 15 along the wellbore wall 17. Some of the mud penetrates the wall 17 of the wellbore 14 and forms an invaded zone 19 along the wellbore wall 17. As shown, the borehole 14 penetrates a formation 16 containing a virgin fluid 22 therein. A portion of the drilling mud seeps into the formation 16 along the invaded zone and contaminates the virgin fluid 22. The contaminated virgin fluid is indicated by reference number 20.

As shown in FIG. 1A, the downhole drilling tool 10*a* is provided with a fluid communication device, such as a probe 2*a*. The probe 2*a* extends from the downhole drilling tool and forms a seal with the mudcake 15 lining the wellbore wall 17. Fluid then flows into the downhole tool 10*a* via the probe 2*a*. As shown, virgin fluid eventually enters the downhole tool.

Figure 1B:
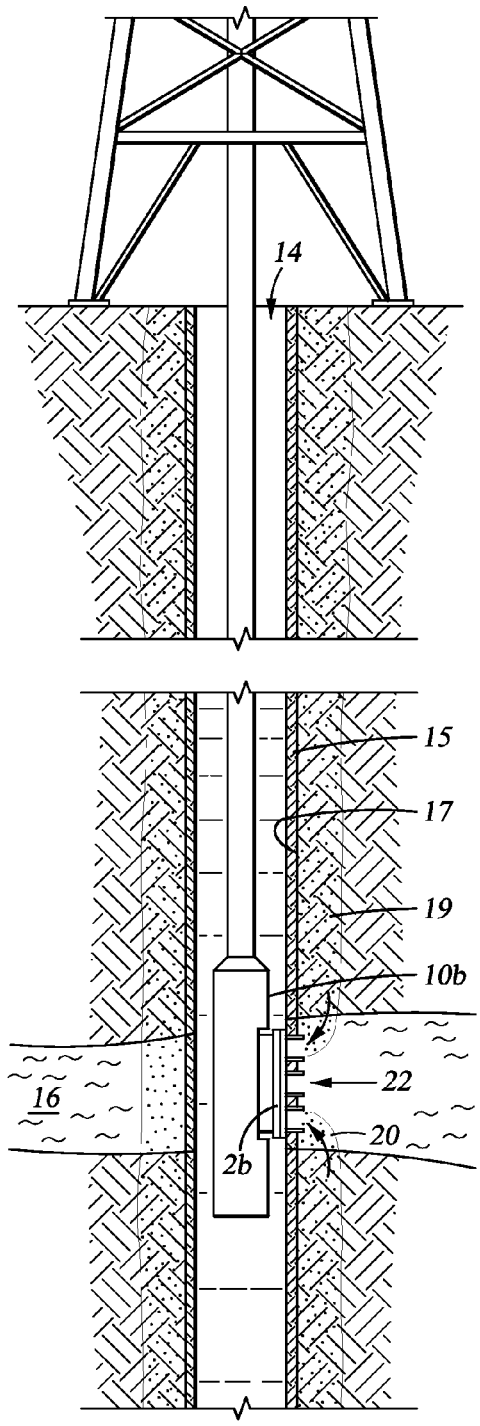
FIG. 1B is a front view, partially in cross-section of a downhole wireline tool deployed from a rig into a wellbore, the downhole wireline tool having a probe with a dual inlet extending therefrom.

In some cases, the drilling tool 10*a* is removed and a separate downhole wireline tool is deployed into the wellbore 14 to perform tests and/or take samples. As shown in FIG. 1B, a wireline tool 10*b* is positioned in the wellbore and a probe 2*b* is extended therefrom to contact the wellbore wall. The probe 2*b* may also be used to draw fluid into the downhole tool. Regardless of the manner the downhole tool operates, be it a wireline, while drilling, etc., the probe and may be designed to improve durability, sealing capability, adaptability to various wellbore conditions and sizes, and deformation resistance, among others.

Figure 2A:
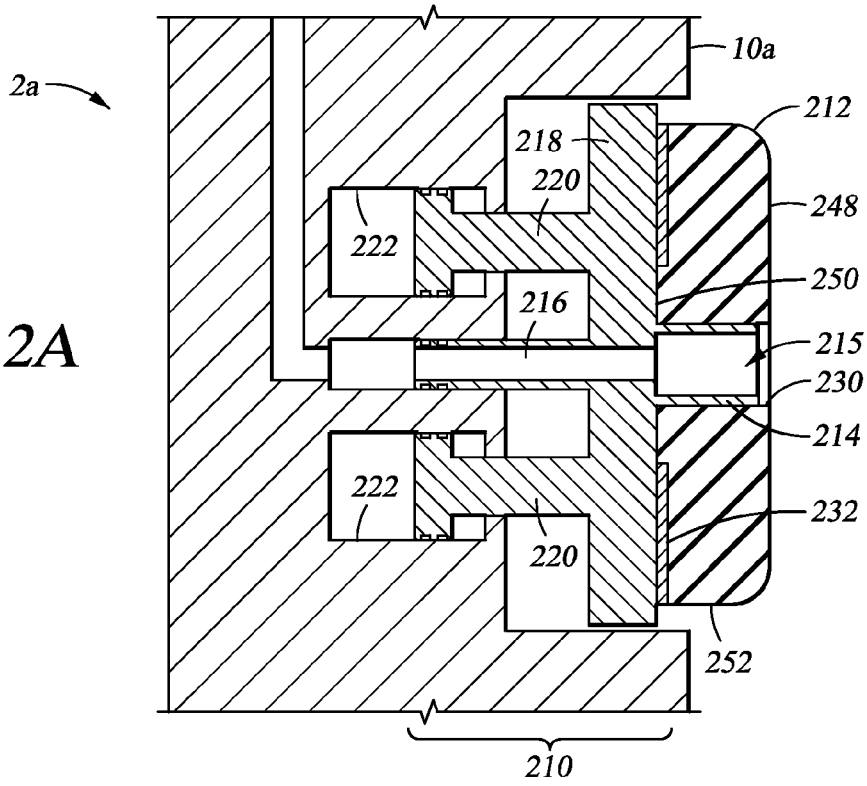
FIG. 2A is a front view, partially in cross-section of the downhole drilling tool of FIG. 1A depicting the probe in greater detail.

As detailed above, the probes 2*a*, 2*b* may be used in a variety of tools. As shown below, the probes 2*a*, 2*b* may also be configured to operate with multiple inlets. Accordingly, the probe and packer configurations disclosed hereafter may be adapted for use in various tools and having one or more inlets. For example, in one embodiment as illustrated in FIG. 2A, the probe 2*a* includes a base 210, a packer 212, an inlet 215 and a flowline 216. The base 210 includes a platform 218 and pistons 220. The base 210 is extendable and retractable from the downhole drilling tool by selective activation of the pistons 220. The pistons 220 are slidably movable in chambers 222 of the downhole drilling tool 10*a*. An actuator (not shown) is provided to selectively manipulate the pressures in the chambers to extend and retract the pistons.

The packer 212 is positioned on the platform 218. As shown, the packer 212 may be secured to a plate 232 which is then secured to the platform 218. Alternatively, the packer 212 may be secure to the platform 218 without the use of the plate 232. The packer 212 and/or plate 232 may be secured to the platform by bonding, mechanical coupling or other techniques. The packer is typically provided with a surface adapted to conform to the platform 218. In some cases, the packer 212 is positioned on a plate that is operatively connected to platform 218 as will be described more fully below.

The packer 212 is typically an elliptical, circular or oblong member having a hole 230 extending therethrough for the passage of fluids. The optional tube 214 extends into the hole 230. The tube 214 defines in part an inlet 215 for the passage of fluid, with the hole 230 also defining part of the inlet 215. In some cases, the tube 230 is adapted to extend and retract to make selective contact with the formation. The tube 230 may be provided with a filter to screen contaminates as the fluid enters the downhole tool.

The packer 212 surrounds the inlet to provide a seal with the formation 16. The seal may be used to prevent fluid from passing between the inlet 215 and the wellbore wall 17. The seal is also used to establish fluid communication with the formation so that fluid may pass through the probe 2*a* without leakage. The packer 212 has typically a curved or arcuate outer surface 248 adapted to contact the usually cylindrical wall of the wellbore. The arcuate outer circle may form part of a circle, ellipse or other shape. The arcuate outer surface 248 may be constructed from a single material, or may be constructed from several sections or materials (see, e.g., FIG. 3D). In some cases, the outer surface 248 may have an arcuate shape also in the vertical direction. The packer typically flattens and conforms to the wellbore wall when the probe is pressed against the wall. The packer 212 has a lower surface 250 adapted to be secured to the plate 232 and/or platform 218. As will be discussed below, alternate packer shapes may be provided. Typically, as the packer 212 is pressed into contact with the wellbore wall 17, the packer 212 deforms and provides a seal.

The packer 212 may be provided with a variety of geometries, such as rectangular, oblong, rounded, etc., depending on the desired function. In some cases, the packer 212 may be elongated so that it may extend across more than one formation during operation. One or more probes and/or packers with one or more inlets may be provided. The inlets may be of varied dimension and size as needed for the specific application. The outer surface 248 of the packer may be shaped for optimal sealing with the wellbore wall as will be described more fully below.

Figure 2B:
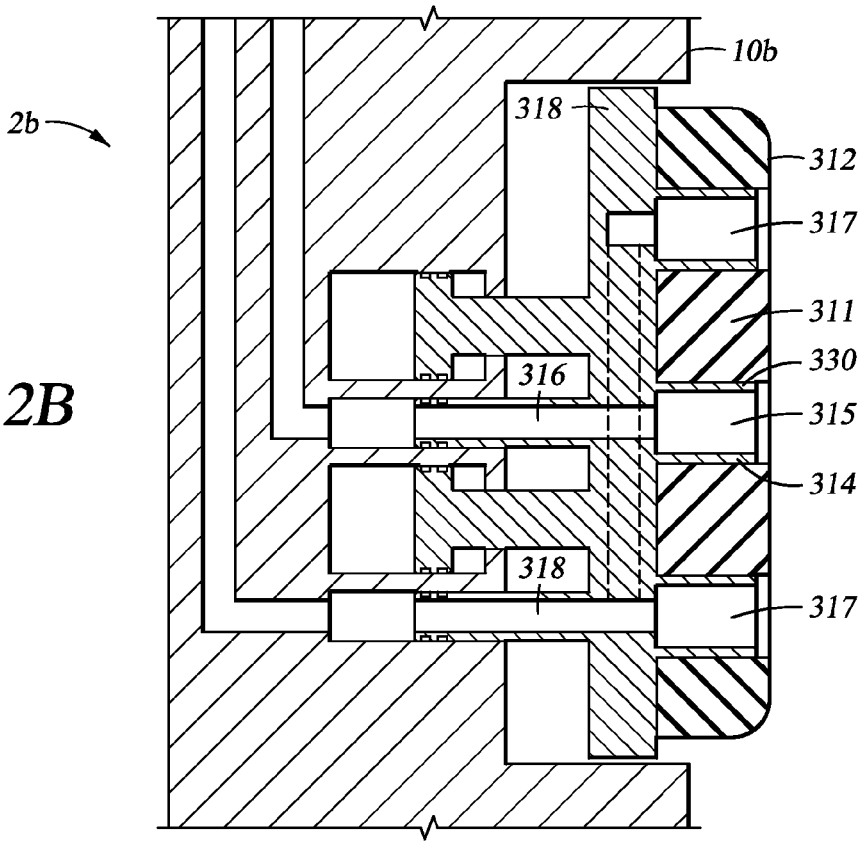
FIG. 2B is a front view, partially in cross-section of the downhole wireline tool of FIG. 1B depicting the probe in greater detail.

For example, as illustrated in FIG. 2B, the probe 2*b* is the same as the probe of FIG. 2A, except that the probe 2*b* has dual packers 312 and 311, dual inlets 315 and 317 and dual flowlines 316 and 318. This configuration provides one embodiment of a probe adapted to draw virgin fluid into a first inlet and contaminated fluid into a second inlet as further described, for example, in U.S. Pat. No. 6,301,959 or US Patent Application No. 2004/0000433.

As shown, the first inlet 315 is defined by tube 314 positioned in a first hole 330 extending through the packer 311. The packer 311 is depicted as an extendable packer adapted to extend from the probe to contact the wellbore wall. An actuator (not shown), such as a hydraulic actuator known in the art, may be provided to extend and retract the packer(s) and/or tube 314. The second packer 312 is positioned about the packer 311. In this position, the packers are concentric and have a gap therebetween that defines the second inlet 317. The first flowline 316 extends from the inlet 315, and the second flowline 318 extends from the inlet 317 and into the downhole tool.

While FIG. 2B shows two concentric packers with a gap therebetween defining the second inlet 317, the probe 2*b* may be provided with a single unitary packer with a channel and/or inlets extending therethrough. These channels and/or inlets may be supported by inserts and define inlets for drawing fluid into the downhole tool. Examples of a probe with additional inlets is described in more detail in co-pending U.S. patent application Ser. No. 10/960,403, the entire contents of which are hereby incorporated by reference.

As such, FIGS. 2A and 2B depict various options for probe configurations. Specifically, FIG. 2A depicts a probe with a single inlet 215, a packer 212, and a tube 214 extendable relative to the packer 212. FIG. 2B depicts a probe with multiple inlets 315, 317, multiple packers 311, 312, a fixed tube, a packer 311 and a packer 312. These options may be interchangeable and provided as desired.

In operation of the probe 2*a* in FIG. 2*a*, the flowline 216 extends from the inlet 215 to the downhole tool. Once a seal is made with the wellbore wall 17, pressure in the downhole tool is lowered to draw fluid therein. Initially, mudcake and contaminated fluid is drawn into the downhole tool. Filters (not shown) are often provided in the probe to remove debris from the fluid as it passes into the downhole tool. As the fluid continues to be drawn into the downhole tool, contamination decreases and more virgin fluid enters the downhole tool. Fluid may tested using measuring devices and/or collected in sample chambers (not shown). In some cases, fluid is dumped into the wellbore, or ejected into the formation. Probe 2*b* operates in a similar manner as described above.

Now turning to FIGS. 3A-3K which depict various packer configurations and packer features that may be used with the probes of FIGS. 2A and/or 2B. These packers are provided with various techniques for supporting the packer and various devices for sealing with the wellbore wall. These devices may cooperate to establish a good seal with the formation. Each of these packers may be provided with one or more holes that may be used (with or without tubes) to define one or more inlets for the passage of fluid therethrough. As described above, the packers and/or inlets may have a variety of dimensions and configurations.

Figure 3A:
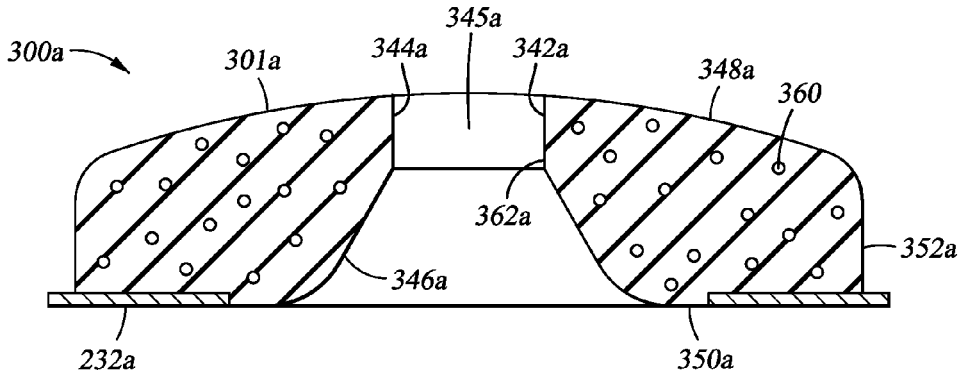
FIGS. 3A-3K are cross-sectional views of a probe having various configurations of a packer and packer supports.

In particular, a packer 300*a* illustrated in FIG. 3A may be constructed of a seal material 301*a*. Preferably, the packer 300*a* is made of a resilient material, preferably an elastomeric material, such as a rubber. Other materials, such as peek, or composite materials comprising rubber and TEFLON amongst others, may also be used. Preferably, the seal material is sufficiently deformable such that it is capable of forming a seal with the mudcake and is able to conform to the wall of the wellbore. The seal material is also preferably strong enough such that it maintains sufficient shape to maintain the seal. The seal material is also preferably durable enough to prevent damage to the packer as the tool is exposed to harsh wellbore conditions and downhole operations.

As shown in FIG. 3A, the packer 300*a* is attached to the plate 232*a*. The packer and plate (if a plate is provided) may then be operatively connected to the platform of the probe as shown in FIG. 2A. The packer 300*a* is provided with a hole 342*a* therethrough adapted to receive a tube similar to the one shown to FIG. 2A if provided. As shown, the hole 342*a* has a first portion 344*a* at an entrance defining an inlet 345*a* through the packer, and a second portion 346*a* extending from the first portion 344*a* to a lower surface 350*a* of the packer. As shown, the first portion is cylindrical, and the second portion is tapered. The packer as shown in FIG. 3A has an arcuate outer surface 348*a* adapted to contact the wall of the wellbore. The dimension of the inlet and/or packer may be varied as desired for optimum seal and/or flow capabilities.

The packer of FIG. 3A is provided with a support in the form of reinforcers 360. These reinforcers may be fabric, metal or other devices positioned in the rubber. For example, wires or threads may be extended through the rubber. The packer may be formed by layering sheets of rubber coated reinforcers 360. Alternatively, the packer may be formed by extruding rubber over groups of the reinforcers. In one example, the packer is forty percent rubber and sixty percent metal mesh. These reinforcers 360 assist in strengthening the packer to reduce the amount of deformation that occurs as the packer is pressed against the wellbore wall.

The reinforcers 360 may be selectively placed in the packer to maximize strength, sealing capability and or durability. For example, it may be desirable to have fewer reinforcers 360 near the outer surface 348*a* where the seal is made, and/or more reinforcers along an outer periphery 352*a* and/or inner periphery 362*a* to prevent the packer from substantially flattening.

Figure 3B:
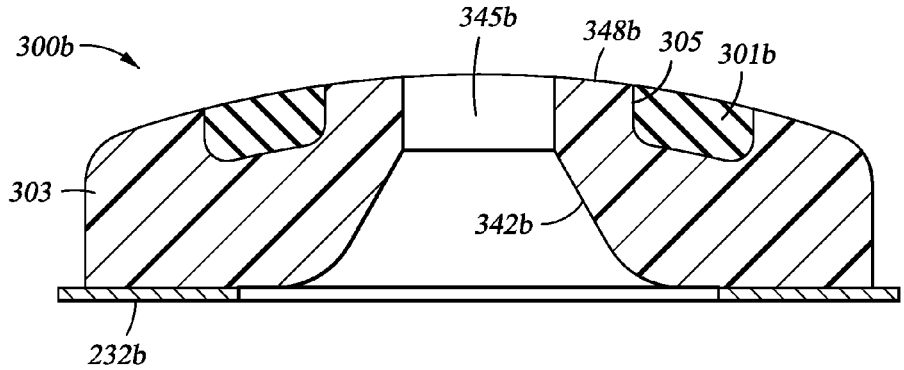

FIG. 3B depicts a packer 300*b* attached to plate 232*b*. The packer has a hole 342*b* extending therethrough. The packer includes a sealing material 301*b* and a support in the form of a support member 303. The support material is attached to the plate and has a cavity 305 that extends from an outer surface 348*b*. The cavity is adapted to receive the sealing material 301*b*.

The support member 303 is preferably a material with less elastic deformation than the sealing material 301*b*. The support material may be, for example, peek, TEFLON, composite or other material that is adapted to provide support and/or reduce the deformation of the packer. The sturdy support material is adapted to maintain the shape of the probe and prevent deformation as the probe is pressed against the wellbore wall. The sealing material 301*b* is preferably an elastomeric material, such as the material 301*a* of FIG. 3A. The sealing material forms a ring around an inlet 345*b* and deforms about the inlet to form the seal. The sealing material 301*b* may be bonded to the support member 303. The sealing and support materials may also be extruded or heated together to form a unitary packer.

Figure 3C:
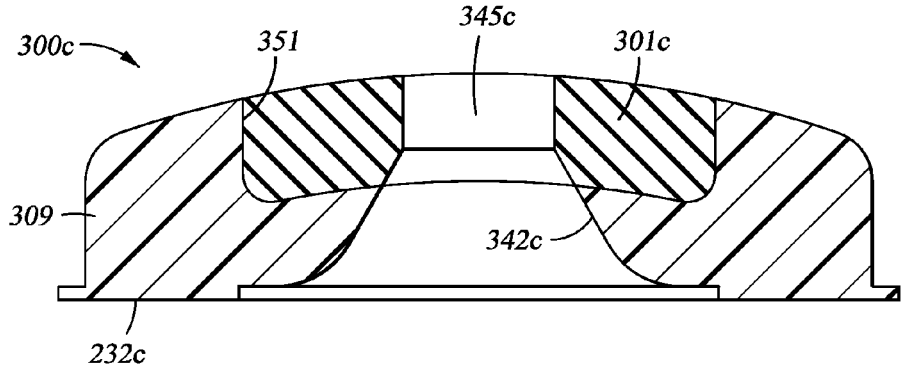

FIG. 3C depicts a packer 300*c*. In this configuration, the packer 300*c* includes a sealing material 301*c* and a support in the form of a support member 309. The support member 309 may be similar the support member 303 of FIG. 3B. In this example, the plate 232*c* is formed integrally support member 309. The support member 309 has an opening or aperture 351 extending about a hole 342*c* extending through the packer 300*c*. The sealing material 301*c* is positioned in the channel 351. The sealing material 301*c* may be a rubber insert, such as a disk or ring that may define a portion of an inlet 345*c* of the packer. In this configuration, a larger portion of the material insert is deformable. Moreover, the sealing material 301*c* is adjacent the inlet.

Figure 3D:
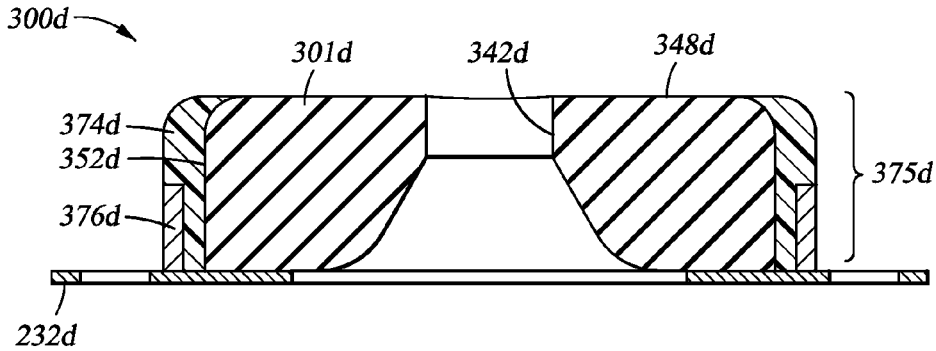

FIG. 3D depicts a packer 300*d* positioned on a plate 232*d*. The packer has a hole 342*d* therethrough and includes a sealing material 301*d* adapted to seal with the wellbore wall. The packer is provided with a support in the form of support member 375*d* is positioned about a periphery 352*d* of the packer. The support member 375*d* includes a first ring 374*d*, and a second ring 376*d*. The first ring 374*d* may be a composite ring adapted to support the outer periphery 352*d* of the packer. As shown, the first ring extends from an outer surface 348*d* of the packer and is affixed to the plate 232*d*. The composite material may be provided with some ability to deform to allow the packer to bend as it contacts the wellbore wall. The second ring 376*d* is preferably made of a sturdy material, such as metal, that permits little or no deformation. The second ring 376*d* is depicted as being attached to plate 232*d*, but extending a distance therefrom. The second ring 376*d* is positioned about a portion of the composite ring to provide support thereto.

One or more rings of various rigidity may be positioned about the periphery of the packer 300*d* to provide peripheral support thereto. The rings may surround the packer to provide support thereto. The rings may be positioned and made of select materials to provide the desired rigidity, deformation and/or durability. As shown, the packer 300*d* is provided with a flat outer surface 348*d*. This figure demonstrates that a variety of configurations may be provided. However, the outer surface 348*d* may be adjusted to provide the desired sealing capability.

Figure 3E:
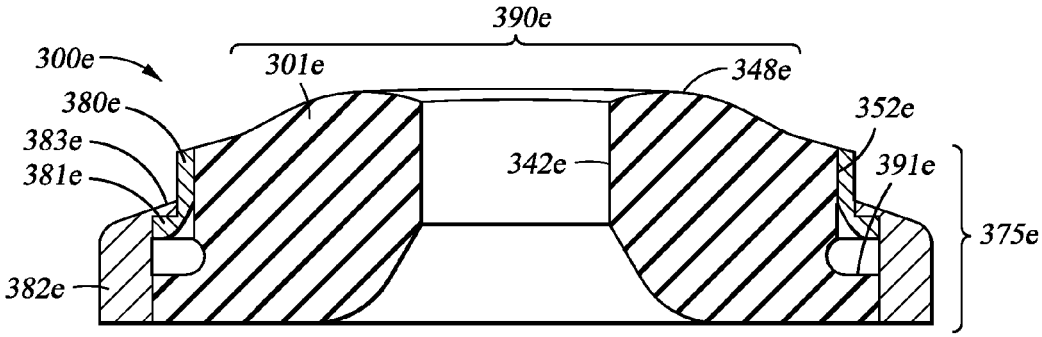

FIG. 3E depicts a packer 300*e* that may be attached to, for example, a platform similar to platform 218 of FIG. 2A. The packer 300*e* includes a sealing material 301*e*. Packer 300*e* is provided with a support in the form of a support system 375*e* that is positioned about a periphery 352*e* of the packer to provide support thereto. The support system 375*e* includes a first ring 380*e* and a second ring 382*e*. The first ring 380*e* is slidably positioned within the second ring 382*e*. The first ring 380*e* is adapted to telescopically extend and retract within the second ring 382*e* and with the packer to provide support. The rings 380*e*, 382*e* are provided with corresponding lips 381*e*, 383*e*, respectively, to act as stops to retain the first ring in the second ring. The rings 380*e*, 382*e* are preferably made of a sturdy material, such as metal to provide support and resistance to deformation to the outer periphery of the packer. The rings 380*e*, 382*e* may be provided with teeth (not shown) to assist the rings in attaching to the sealing material.

The sealing material 301*e* has a hole 342*e* therethrough and an outer surface 348*e* that is generally concave. However, around adjacent hole 342*e*, the sealing material 301*e* has a raised portion 390*e*. The raised portion 390*e* is generally convex to provide an initial contact surface with the wellbore wall. Additionally, the packer 300*e* is provided with a slot or void 391*e* adapted to permit movement of the first ring 380*e* about the periphery of the packer and/or to provide an area for sealing material to move as it deforms. Keyways and/or ears may be provided in the rings and/or sealing material to prevent relative rotation therebetween.

Figure 3F:
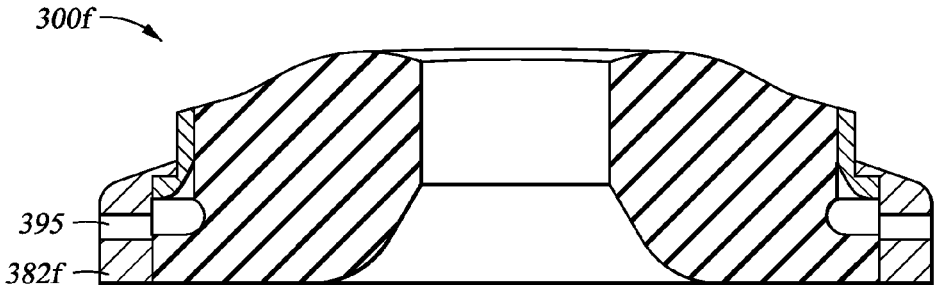

Packer 300*f* of FIG. 3F is similar to the packer 300*e* of FIG. 3E, except that the outer metal ring is provided with mud holes 395 through second ring 382*f*. This may be used to permit fluid flow. This may assist in preventing pressure buildup within the packer.

Figure 3G:
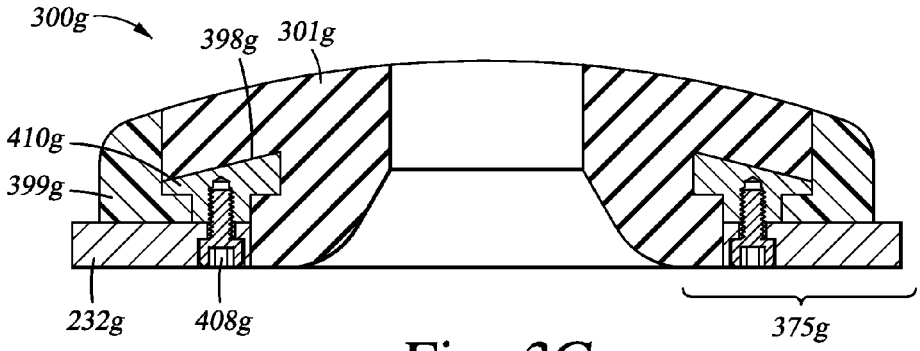

FIG. 3G depicts a packer 300*g* positioned on a plate 232*g*. The packer includes a sealing material 301*g* with a support in the form of a support ring 375*g* about a periphery thereof. The support ring includes an embedded ring 398*g*, and a peripheral ring 399*g*. The embedded ring is connected to the plate by bolts or screws 408*g* and extends into the sealing material 301*g*. The embedded ring may be a metal ring adapted to provide internal support to the sealing material. The peripheral ring 399*g* is positioned on the plate 232*g* and extends a distance therefrom. The peripheral ring 399*g* is positioned about the periphery of the packer. A portion of the peripheral ring 399*g* is positioned between a shoulder 410*g* of the embedded ring and the plate 232*g*. The peripheral ring 399*g* may be secured to the plate 232*g* by bonding and/or by the embedded ring 398*g*. The peripheral ring 399*g* may be of the same material as the sealing material 301*g*, or form an unitary part with the sealing material 301*g* after heating. The peripheral ring 399*g* may also be made of a stiff material such as peek or metal.

Figure 3H:
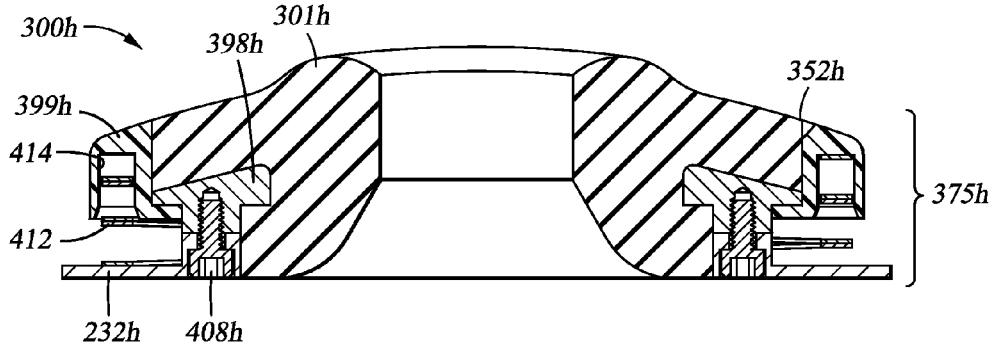

FIG. 3H depicts a packer 300*h* secured to plate 232*h*. The packer 300*h* includes a sealing material 301*h*. The packer 300*h* is provided with a support in the form of a support ring 375*h* positioned about a periphery 352*h* of the packer. The support ring 375*h* includes an embedded ring 398*h*, a peripheral ring 399*h* and a spring 412. The embedded ring 398*h* and bolts 408*h* may be the same as the embedded ring 398*g* and bolts 408*g* of FIG. 3G. The support ring 399*h* may be the same as the support ring 399*g* of FIG. 3G, except that it has a cavity 414 extending therein adapted to receive the spring 412. The spring 412 is operatively connected to the plate 232*h* and the peripheral ring 399*h* to permit bending thereof. The spring 412 preferably reduces loads on the packer, and permits some movement of the peripheral ring 399*h* about the packer 300*h*.

Figure 3I:
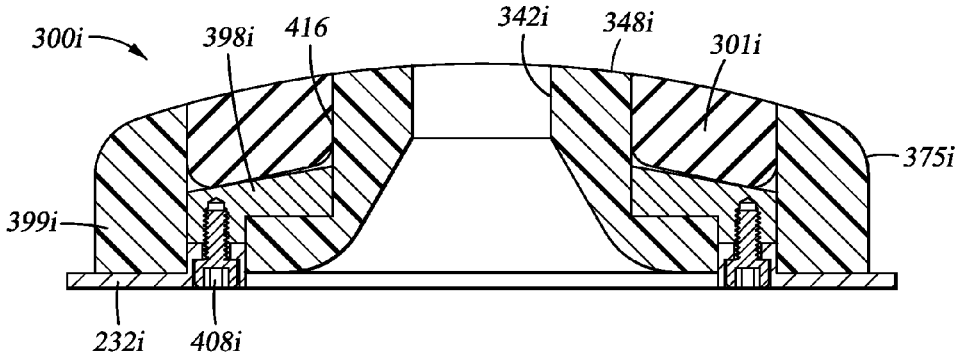

FIG. 3I depicts a packer 300*i* attached to plate 232*i*. The packer 300*i* has a hole 342*i* therethrough. The packer 300*i* includes a sealing material 301*i* and a support in the form of a support ring 375*i*. The support ring 375*i* includes a peripheral support 399*i*, and an embedded support 398*i*. The peripheral support 399*i* has a cavity 416 extending inwardly from an outer surface 348*i* of the packer. The peripheral support provides resistant to deformation along the periphery. The cavity 416 is adapted to receive the sealing material 301*i* and the embedded support 398*i*. The embedded ring 398*i* is positioned in the cavity between the sealing material and the peripheral support. The embedded support provides some support but allows more deformation than the peripheral support.

The sealing material 301*i* is positioned in the cavity 416 and defines a portion of the outer surface 348*i* of the packer. The sealing material 301*i* is preferably sufficiently flexible to permit a good seal. The sealing material 301*i* is supported by the embedded and peripheral supports. The inner peripheral support is provided to assist in preventing the sealing material from flowing into the hole and cutting off flow as it is pressed against the wellbore wall. The embedded and peripheral supports may be attached to plate 232*i* by bolts or screws 408*i*. The sealing material may be bonded to the embedded and/or peripheral supports.

Figure 3J:
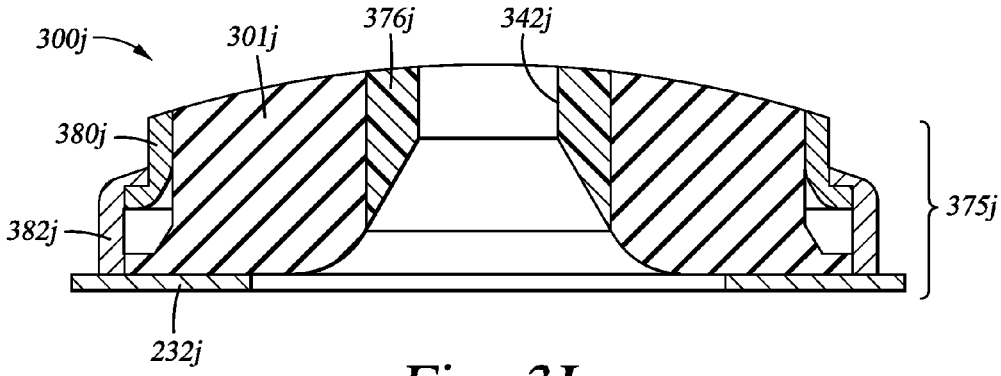

FIG. 3J illustrates a packer 300*j* positioned on a plate 232*j*. The packer has a hole 342*j* extending therethrough. The packer includes a packer material 301*j*. The packer is provided with supports in the form of an outer peripheral support system 375*j* and an inner peripheral support ring 376*j*. The inner peripheral support ring 376*j* is preferably made of a material with less elasticity that the sealing member to provide support thereto. The inner peripheral support ring may be of the same material as the outer peripheral support system 375*j*. The material may be selected based on its ability to provide support and prevent deformation as desired. The inner peripheral support 376*j* is positioned about hole 342*j* to provide support to the inner periphery of the packer to assist the sealing material in forming a seal with the wellbore wall. The inner peripheral support 376*j* is also provided to prevent extrusion of the sealing material into the hole 342*j* where it would limit flow therethrough. The outer peripheral support ring system 375*j* includes an inner ring 380*j* and an outer ring 382*j*.

The packers and/or probes provided herein may be provided with inner, peripheral and embedded supports. Various types of inner, peripheral and/or embedded supports may be used with a variety of probe configurations. The shape of the packer may be modified to receive the support and/or form a seal with the wellbore wall. Similarly, the materials, configurations and shapes of the packers set forth herein may be interchanges and selected for the specific application.

Figure 3K:
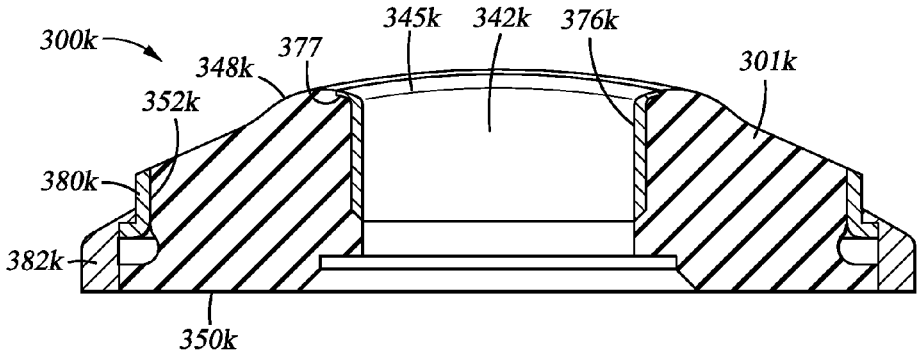

For example, as illustrated in FIG. 3K, a packer 300*k* includes a inner support member 376*k*. The inner support member 376*k* may at least partially define an inlet 345*k* of the packer and may extend from an outer surface 348*k* of the packer to a lower surface 350*k* of the packer. The inner support 376*k* may further include a lip 377 extending outwardly at the outer surface 348*k* of the packer to partially define the outer surface 348*k*. Preferably, at least a portion of a packer material 301*k* extends beyond the lip 377 to ensure a seal against the borehole wall. The inner support member 376*k* may also define at least a portion of a hole 342*k* to provide support to the inner periphery of the packer to assist the sealing material in forming a seal with the wellbore wall. An outer periphery 352*k* of the packer 300*k* includes a support system 375*j* including an inner ring 380*k* and an outer ring 382*k*.

Figure 3L:
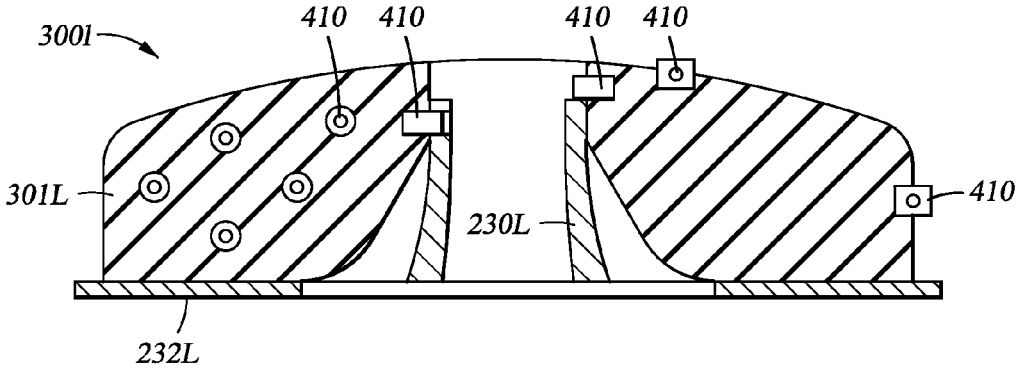
FIG. 3L is a cross-sectional view of a probe having sensors therein.

FIG. 3L depicts a packer 300L that includes a sealing material 301L with embedded sensors 410. The packer 300L is positioned on a plate 232L. The packer 300L is depicted with tube 230L extending therethrough. As shown, the sensors 410 may be positioned about the packer 300L, the tube 230L or other portions of the probe to measure downhole parameters. In some cases, the sensors 410 are used to measure stresses on the packer 300L. In other cases, the sensors 410 may be used to measure formation and/or wellbore fluid parameters. Other characteristics of downhole conditions and/or operations may also be measured by these sensors. These sensor 410 may be, for example pressure gauges, fluid analyzers, mechanical stress sensors, temperature sensors, displacement sensors, load sensors, acoustic sensors, optical sensors, radiological sensors, magnetic sensors, electrochemical sensors, or other sensor capable of taking downhole measurements.

Such sensors 410 may be extruded into the sealing material, or attached to the probe at the desired location. When embedded in the sealing material, the sensors 410 may also provide support thereto. The sensors may be operatively connected, using wired or unwired techniques, to processors, memories or other devices capable of collecting, storing and/or analyzing the data collected by the sensors and known to those of ordinary skill in the art. The sensors 410 may be provided with antennas or other communication devices for transferring data from the sensors to the downhole tool and/or surface.

Figure 3M:
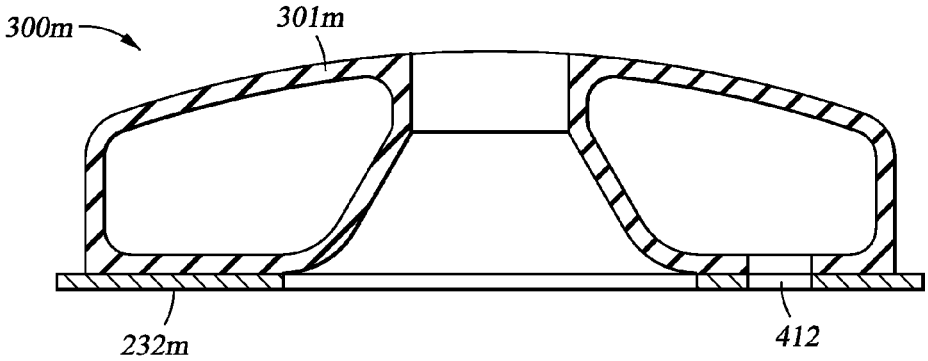
FIG. 3M is a cross-sectional view of a probe having an inflatable packer.

FIG. 3M depicts a packer 300*m* affixed to plate 232*m*. The packer includes a sealing material 301*m*. In this case, the packer 300*m* is a hollow ring. The packer 300*m* may be provided with an inlet 412 for receiving a fluid. The packer 300*m* may then be selectively inflated and/or deflated as desired to achieve the desired rigidity, seal or other performance characteristic. The packer 300*m* may be inflated in the same manner as the dual packers are inflated. Techniques for inflating dual packers are described in more detail in U.S. Pat. No. 4,860,581, the entire contents of which is hereby incorporated by reference.

Figure 3N:
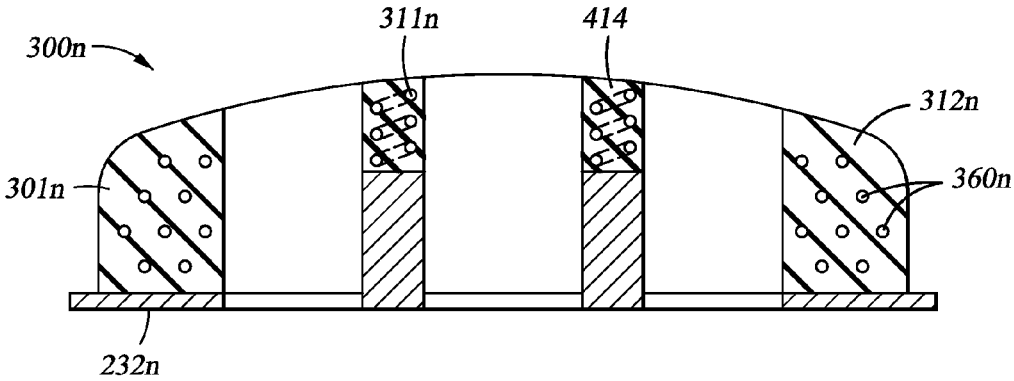
FIG. 3N is a cross-sectional view of a probe with dual inlets.

In FIG. 3N a packer 300*n* includes an inner packer 311*n* and an outer packer 312*n*. Outer packer 312*n* includes a sealing material 301*n* and supports in the form of reinforcers 360*n*. Any of the supports of the previous figures may be used. Inner packer 311*n* includes the sealing material 301*n* with a support in the form of a spring 414. The spring 414 is adapted to provide support while permitting some deformation as the packer presses against the wellbore wall. The inner packer may be movable as shown in FIG. 2B, or fixed to plate 232*n*.

Figure 4A:
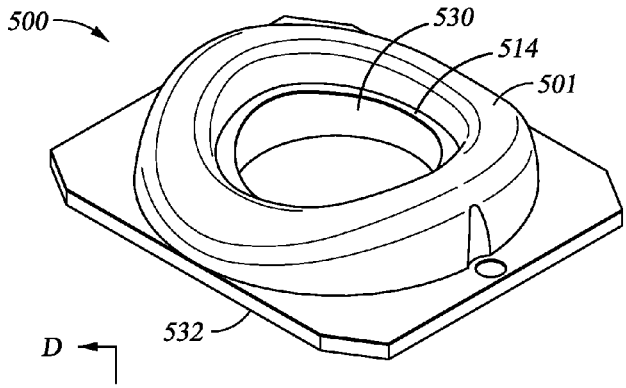
FIG. 4A is an isometric view of probe having an extended radius.
Figure 4B:
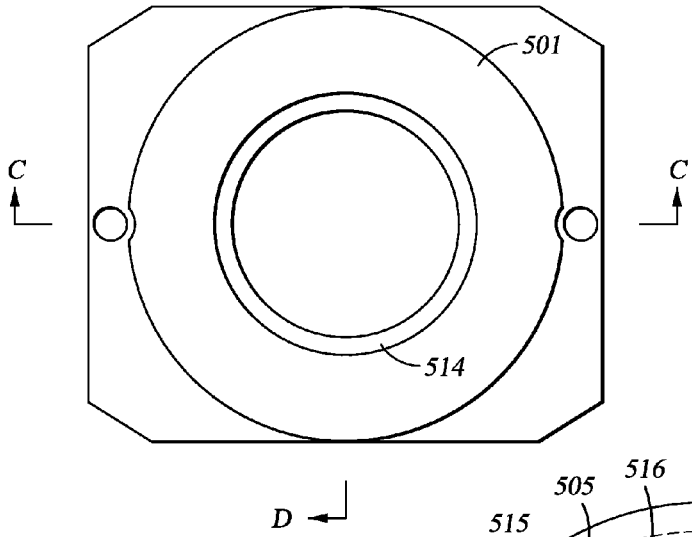
FIG. 4B is a top view of the probe of FIG. 4A.
Figure 4C:
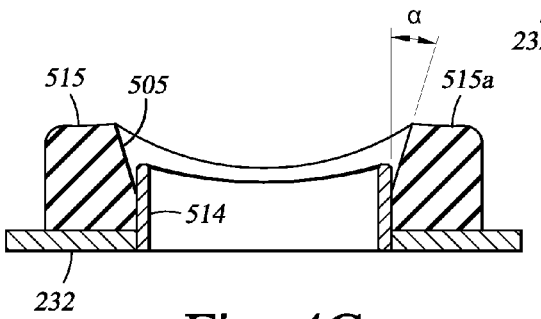
FIG. 4C is a cross-sectional view of the probe of FIG. 4B along line C-C.
Figure 4D:
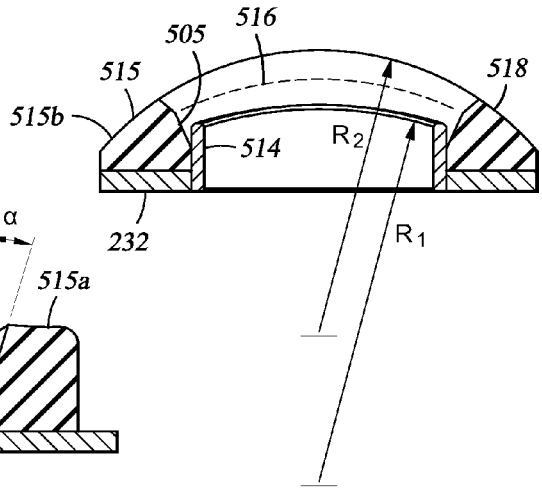
FIG. 4D is a cross-sectional view of the probe of FIG. 4B along line D-D.

FIGS. 4A-D depicts the dimension of a packer 500. The packer 500 is made of a sealing material 501 affixed to plate 532. The packer has a hole 530 extending therethrough. The packer is shown with tube 514 positioned therein. As shown in FIGS. 4C and 4D, the packer 500 has a generally circular shape and is provided with a tapered inner surface 505 and a contoured outer surface 515. The inner surface 505 is preferably angled away from the tube 514 at an angle $\alpha$ to prevent abrasion or excessive contact therebetween.

The outer surface of the packer is preferably shaped to contact the wellbore wall and conform thereto. FIG. 4C is a cross-sectional view of the probe of FIG. 4B along line C-C. As shown in FIG. 4C, the vertical portion of the probe has a flat outer surface 515*a* that conforms to the vertical portion of the wellbore wall. The shape of the tube 514 is also substantially flat so that it will also conform to the vertical portion of the wellbore wall when the probe is engaged.

FIG. 4D is a cross-sectional view of the probe of FIG. 4B along line D-D. As shown in FIG. 4D, the curved portion of the probe has an arcuate outer surface 515*b* that conforms to the arcuate shape wellbore wall. However, while the tube 514 is shaped to substantially conform to the arcuate shape of the wellbore wall as indicated by R1, the outer surface of the packer has a slightly exaggerated shape as indicated by R2. The dashed line 516 represents an outer surface having an arcuate packer shape that conforms to the wellbore wall. Solid line 518 depicts an extended outer surface that has the radius R2 that extends beyond the radius of the wellbore or R1. This extended radius of the packer is intended to equalize the forces about the packer.

The probes may have one or more inlets for receiving fluids. The probes may be adapted to receive fluid into or eject fluid from the downhole tool. The packers may also be provided with reinforcement, sensors, inflation or other devices. Other probe devices, such as filters, valves, actuators and other components may be used with the probe(s) described herein.

In addition to or as an alternative to the various packer configurations described above, the relative shape of the packer may be manipulated to obtain a more homogenous contact pressure distribution of the packer as it is pressed against the borehole wall. This is contrary to currently available packers that have a non-homogenous contact pressure distribution about the packer. Specifically, currently available packers are commonly shaped in an attempt to match a profile of the borehole wall, as is illustrated in FIG. 5A. In such a configuration, the packer has a constant thickness along a vertical plane of the packer as illustrated in FIG. 5B, and a variable thickness along a horizontal plane as seen in FIG. 5C to accommodate for the curvature of the borehole wall. As can be seen by comparing the cross-sections of the packer, the packer is thicker along its vertical plane than its horizontal plane. This variation of thickness may cause a non-homogenous contact pressure distribution on the wellbore wall when the packer is applied to the wall. This non-homogenous contact pressure may provide leak paths between the packer and the borehole wall. More particularly, the areas about the packer having the least contact pressure will provide the greatest chance for a leak path. As this particular packer is pressed against the borehole wall, the areas of undergoing the least contact pressure and, hence, the greatest possibility for a leak path, are located along the vertical axis as is identified in FIG. 5A by areas "LP".

Figure 6A:
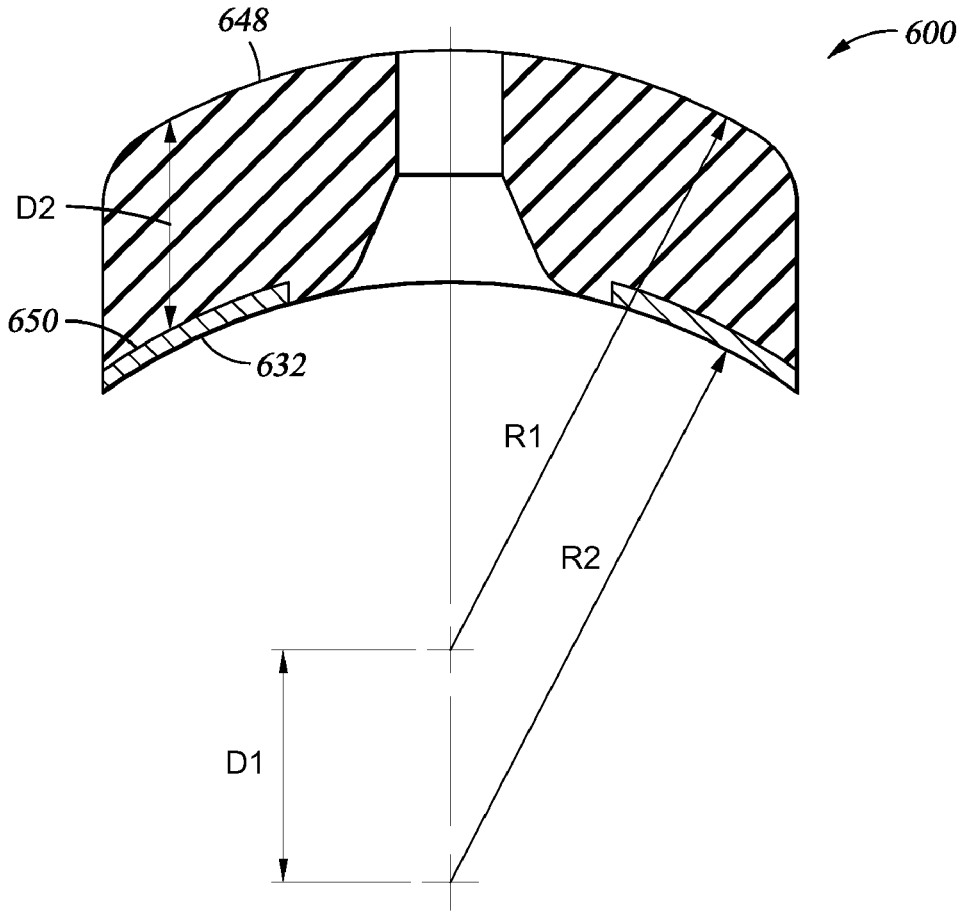
FIG. 6A is a horizontal cross-sectional view of another embodiment of a packer.
Figure 6B:
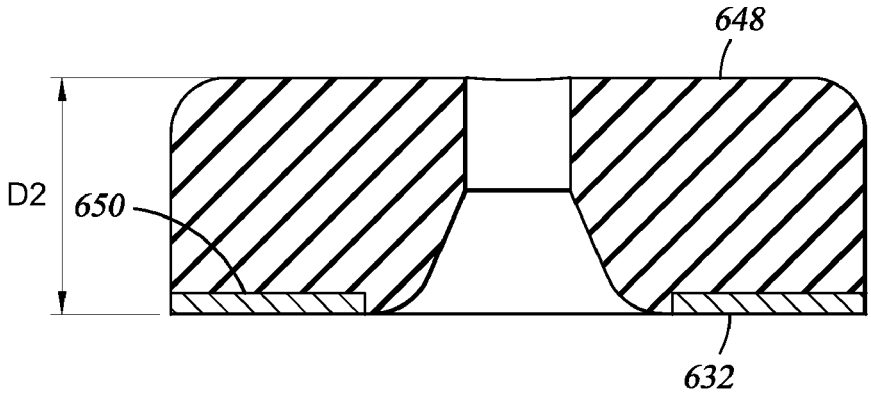
FIG. 6B is a vertical cross-sectional view of the packer of FIG. 6A.

One manner of providing a constant contact pressure about a packer 600 is illustrated in FIGS. 6A and 6B. In this embodiment, an outer surface 648 of the packer 600 has a generally cylindrical shape with a horizontal curvature radius R1 that is equal to, or at least substantially similar to, a radius of the wellbore. An inner surface 650 of the packer may be bonded or otherwise attached to a plate 632 having a generally cylindrical shape that has a curvature R2 that is equal to, or at least substantially similar to, the curvature radius R1. The centers of curvature of inner surface 648 and outer surface 650 corresponding to radii R1 and R2 respectively, are a distance D1 apart which, in this embodiment, is equal to, or at least substantially similar to D2—the substantially uniform distance between the outer and inner surfaces 648, 650 of the packer 600, or the thickness of the packer 600.

Figure 7A:
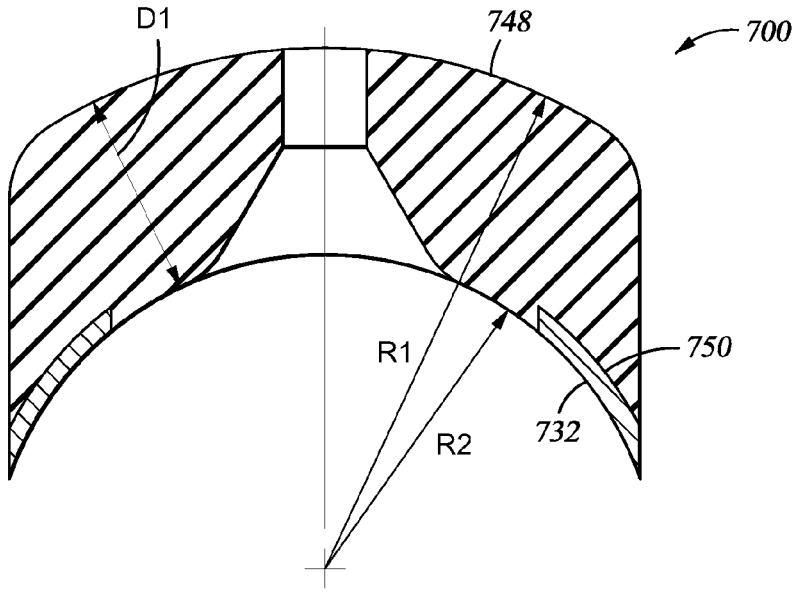
FIG. 7A is a horizontal cross-sectional view of another embodiment of a packer.
Figure 7B:
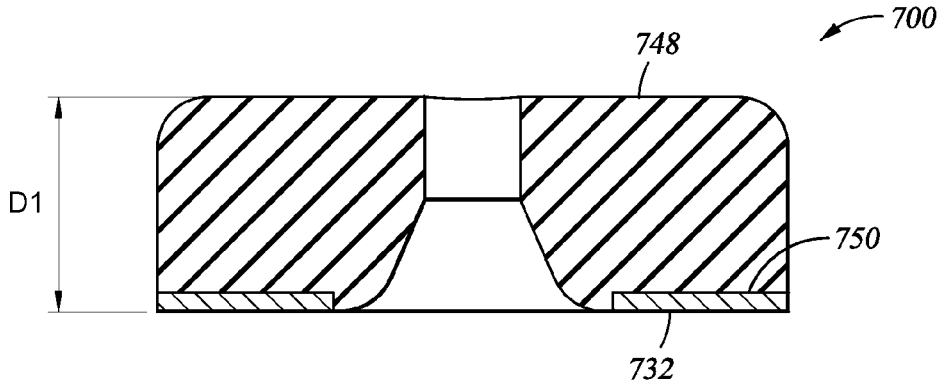
FIG. 7B is a vertical cross-sectional view of the packer of FIG. 7A.

In another embodiment, as illustrated in FIGS. 7A and 7B an outer surface 748 of a packer 700 has a generally cylindrical shape with a horizontal curvature radius R1 that is equal to, or at least substantially similar to, a radius of the wellbore. An inner surface 750 of the packer 700 may be bonded or otherwise attached to a plate 732, and has a generally cylindrical shape that has a horizontal curvature radius R2. In this embodiment, however, the outer surface 748 and inner surface 750 have the same center of curvature. In other words, R1 is equal, or at least substantially similar, to R2 plus a distance D1 which is the distance between the outer and inner surfaces 748, 750 of the packer, or is the thickness of the packer. As the packer is pressed against the borehole wall, a substantially homogenous contact pressure is achieved around the probe thereby limiting and/or at least greatly reducing the possibility for a leak path.

Alternately worded, D2 the thickness of the packer and D1 the distance between the centers of curvature in FIG. 6A, 6B, 7A and 7B, can be generalized by the equation R1+D1=R2+D2. Note that in FIGS. 7A and 7B D1=0.

Figure 8A:
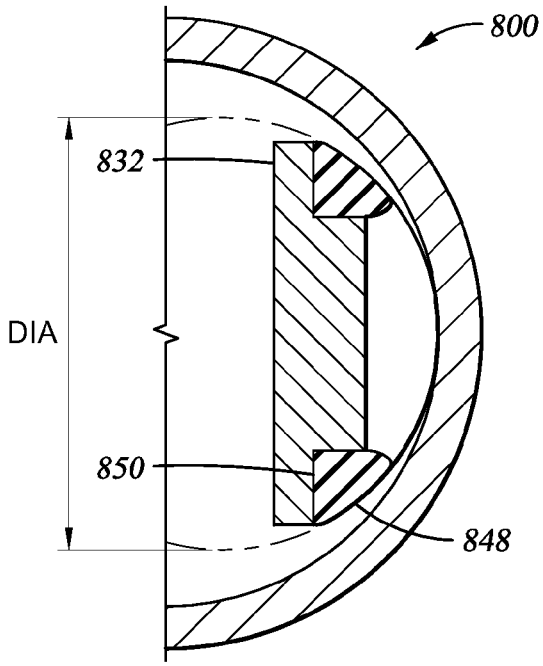
FIG. 8A is a horizontal cross-sectional view of another embodiment of a packer prior to engaging a wellbore wall.
Figure 8C:
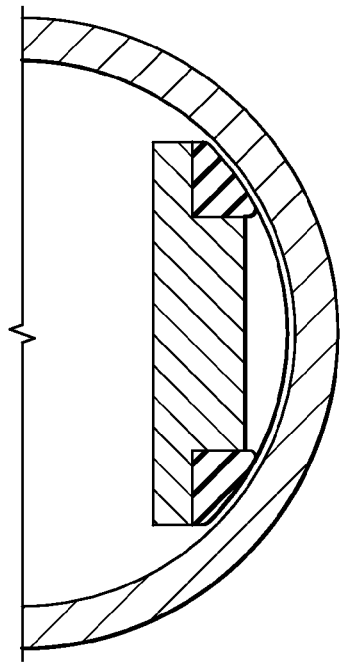
Fig. 8C (PRIOR ART)
FIG. 8C is a horizontal cross-sectional view similar to FIG. 8A of a prior art packer prior to engaging a borehole wall.
Figure 8B:
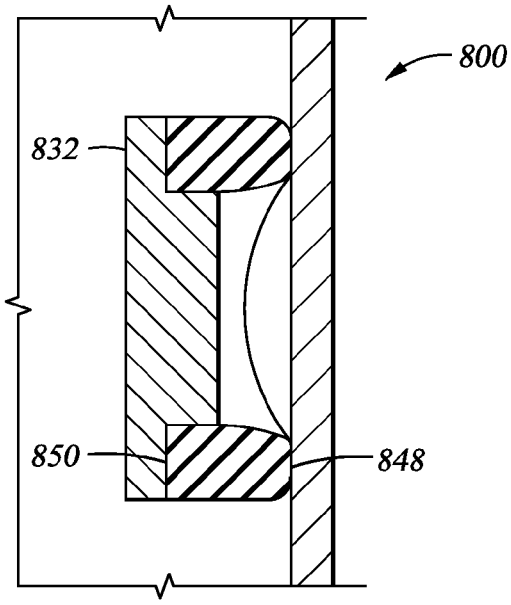
FIG. 8B is a vertical cross-sectional view of the packer of FIG. 8A.
Figure 8D:
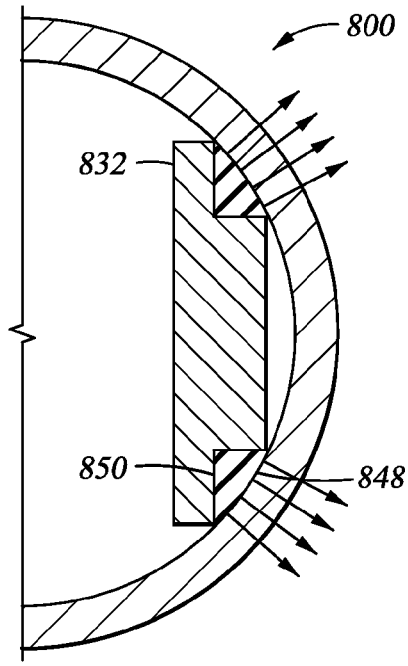
FIG. 8D is the same horizontal cross-sectional view as in FIG. 8A, with the packer fully engaged with the wellbore wall.
Figure 8E:
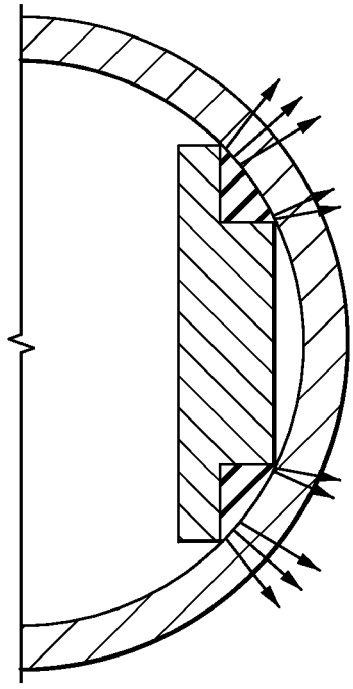
Fig. 8E (PRIOR ART)
FIG. 8E is a horizontal cross-sectional view of the prior art packer of FIG. 8C while engaging the borehole wall.

In another embodiment, as illustrated in FIGS. 8A, 8B and 8D, an outer surface 848 of a packer 800 has a generally cylindrical shape with a horizontal curvature radius R1 that is less than a radius of the wellbore. An inner surface 850 of the packer 800 may be bonded or otherwise attached to a generally flat, planar, or at least less curved, plate 832. Thus, the packer 800 will on average be thicker along its vertical plane (FIG. 8B) than its horizontal plane (FIG. 8A), and will be configured such that the curvature of the packer is less than the borehole wall. It is noteworthy to point out that it is generally understood that thinner cross-areas or portions of the packer usually undergo greater amounts of stress and/or strain than thicker cross-sectional areas or portions of the packer, assuming even deformation of the outer surface of the packer. Therefore, thicker cross-sectional areas or portions of the packer will generally apply a lower pressure on the wellbore wall than thinner cross-sectional areas or portions of the packer. For example, as illustrated in FIG. 8C, the packer has a curvature equal to the curvature of the wellbore wall. As the packer engages the wall, an entire outer surface of the packer will contact the well bore at substantially the same time. Once this packer is pressed against the borehole wall, as illustrated in FIG. 8E, the pressure on the packer will be greatest near the peripheries of the packer, as illustrated by the arrows, where the packer is thin and/or abuts edges of the support members or other packer structure.

In this embodiment, however, as best seen in FIGS. 8A and 8B, the thicker portions of the packer, such as the areas along the vertical plane and the areas around the inner diameter of the packer, will generally touch or abut the borehole wall before the thinner areas of the packer as the packer is compressed against the borehole wall. In using this non-parallel configuration between the wellbore wall and the outer surface of the packer, the thicker portions of the packer will undergo greater deformation compared to the thinner areas, thereby creating a substantially even stress distribution around the packer as is illustrated with arrows in FIG. 8D. As will be shown below, this hold true for many variations of borehole diameters. For example, testing determined that a packer having a curvature or diameter of 6.125" (Dia. in FIG. 8A) will create a proper seal against a borehole having diameters of 8", 10" and 12.25". In testing it was determined that a packer having a curvature of 6.125" may also sufficiently seal against a borehole wall having a curvature of 6". The testing was conducted by engaging a dual inlet packer (see FIGS. 2B and 3N) with a portion of a casing and placing a pressurized source of air at approximately 110 psi into fluid communication with the inlets of the packer. The packers were then checked to determine if a leak from an inner or outer packer was present. If no leak was detected, then the seal between the packer and the casing would be considered to be proper.

Figure 9:
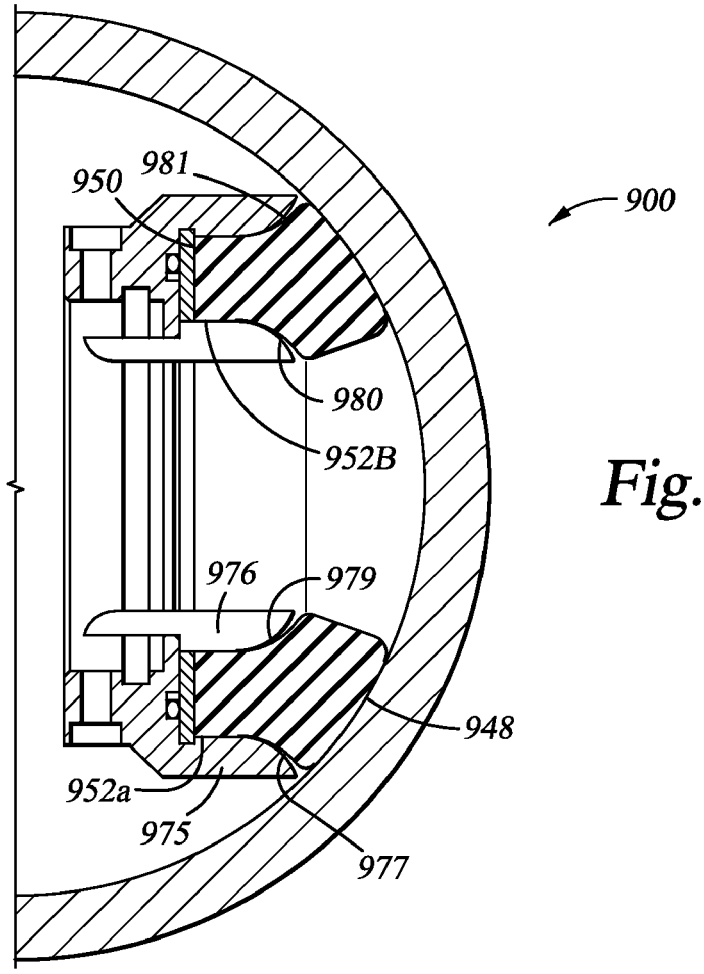
FIG. 9 is a cross-sectional view of a probe with rounded support members.

A packer 900 shown in FIG. 9 may further include inner and/or outer support members 976, 975 designed to accommodate the deformation of the inner and outer edges of the packer 900. In particular, as the packer 900 presses against the wellbore wall, the edges or peripheries 952*a*, 952B of the packer may creep outwardly to accommodate the compressive forces. An outer and/or inner support member having a straight or non-curved edge disposed around a packer may pinch, cut and/or weaken the packer 900. Accordingly, in one embodiment, ends 980, 981 of the support members 976, 975 may include a curved or radius edge 979, 977 to permit the packer material displaced during compression of the packer against the borehole wall to roll or abut a smooth or curved portion to prevent damage to the packer 900. More specifically, the support members 976, 975 may be disposed along the inner and outer peripheries, respectively, of the packer 900, such that the ends 980, 981 are disposed between an inner surface 950 and an outer surface 948 of the packer 900. As illustrated in FIG. 9, in this configuration, the peripheral sides of the packer will gradually engage the curved or radiused 979, 977 edges of the support members 976, 975 as the packer 900 is compressed against the borehole wall, thereby preventing the packer from becoming pinched or cut.

It will be understood from the foregoing description that various modifications and changes may be made in the preferred and alternative embodiments of the present invention without departing from its true spirit. For example, the internal and/or external support may remain fixed as the probe extends, or extend with the probe. When extendable, the supports may be telescopically extended, spring loaded, and adjustable. The external support may be connected to the downhole tool and/or the probe. Various combinations of the supports and the amount of surface area contact with the packer are envisioned.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A probe for establishing fluid communication between a downhole tool and a subterranean formation, the downhole tool positioned in a wellbore penetrating the subterranean formation, comprising:

a platform operatively connected to the downhole tool:

a packer operatively connected to the platform, the packer having at least one hole extending therethrough; and embedded members disposed in the packer for enhancing the operation of the packer as it is pressed against the wellbore wall whereby the packer forms a seal with the wellbore wall;

wherein the embedded members substantially comprise metal, and wherein the packer is forty percent elastomeric and sixty percent metal;

wherein the elastomeric forty percent of the packer substantially comprises a composite material comprising rubber and polytetrafluorethylene (TEFLON); and wherein the embedded members include:

and a plurality of metal wires that reinforce the packer and that are more numerous near inner and outer peripheries of the packer and less numerous in a sealing area between the inner and outer peripheries.

2. An apparatus, comprising:

a downhole tool configured to be positioned in a wellbore penetrating a subterranean formation, wherein the downhole tool comprises:

a probe configured to establish fluid communication between the downhole tool and the subterranean formation, wherein the probe comprises:

a platform operatively connected to the downhole tool; and a packer operatively connected to the platform, wherein:

the packer has a hole extending therethrough a central axis of the packer;

a first portion of the packer comprises 40% of the packer;

a second portion of the packer comprises 60% of the packer;

the first portion of the packer is elastomeric comprising a composite of rubber and polytetrafluorethylene (TEFLON);

the second portion of the packer comprises a plurality of embedded metal members disposed in the first portion;

the plurality of embedded metal members are more numerous near inner and outer peripheries of the packer and less numerous in a sealing area between the inner and outer peripheries; and the plurality of embedded metal members comprises a plurality of metal reinforcement members positioned near the outer periphery of the packer.

* * * * *